US011586138B1

(12) United States Patent
Ikeda

(10) Patent No.: US 11,586,138 B1
(45) Date of Patent: Feb. 21, 2023

(54) IMAGE FORMING DEVICE

(71) Applicant: TOSHIBA TEC KABUSHIKI KAISHA, Tokyo (JP)

(72) Inventor: Wataru Ikeda, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 44 days.

(21) Appl. No.: 17/392,481

(22) Filed: Aug. 3, 2021

(51) Int. Cl.
*G03G 15/00* (2006.01)

(52) U.S. Cl.
CPC . *G03G 15/6573* (2013.01); *B65H 2301/5133* (2013.01); *B65H 2404/561* (2013.01); *G03G 15/6552* (2013.01)

(58) Field of Classification Search
None
See application file for complete search history.

(56) References Cited

U.S. PATENT DOCUMENTS

2005/0281598 A1* 12/2005 Hattori ..... G03G 21/1609 399/405

FOREIGN PATENT DOCUMENTS

| | | | |
|---|---|---|---|
| JP | 02113286 | | 4/1990 |
| JP | 09124206 | | 5/1997 |
| JP | 2007-168947 | | 7/2007 |
| JP | 2009128692 A | * | 6/2009 |
| JP | 2016008101 A | * | 1/2016 |
| JP | 2017-071462 | | 4/2017 |

* cited by examiner

*Primary Examiner* — Jennifer Bahls
(74) *Attorney, Agent, or Firm* — Amin, Turocy & Watson, LLP

(57) ABSTRACT

An image forming device includes an image forming unit, a roller unit, a static elimination brush, a moving unit, and a control unit. The static elimination brush eliminates static electricity of the printing medium. The moving unit moves the static elimination brush between a first position that does not intersect a first conveyance path on a downstream side of the roller unit in the conveyance path and a second position that intersects the first conveyance path. The control unit controls the moving unit during the conveyance of the printing medium, positions the static elimination brush at a position different from the second position until a front end of the printing medium passes an intersection position at which the static elimination brush and the first conveyance path intersect if the static elimination brush is positioned at the second position, and moves the static elimination brush to the second position after the front end of the printing medium passes the intersection position until a rear end of the printing medium passes the intersection position.

20 Claims, 7 Drawing Sheets

IMAGE FORMING DEVICE

FIELD

Embodiments described herein relate generally to an image forming device.

BACKGROUND

In the related art, an image forming device that eliminates static electricity from a print medium with a static elimination brush is known. In such an image forming device, the stronger the static elimination brush is brought into contact with the print medium, the higher the static elimination efficiency. However, if the static elimination brush is strongly brought into contact with the print medium, the front end of the print medium may be blocked by the static elimination brush. In this case, the image forming device causes a paper jam.

DETAILED DESCRIPTION

In general, according to one embodiment, an image forming device is described with reference to the drawings, taking an image forming device 1 as an example.

Figure 1:
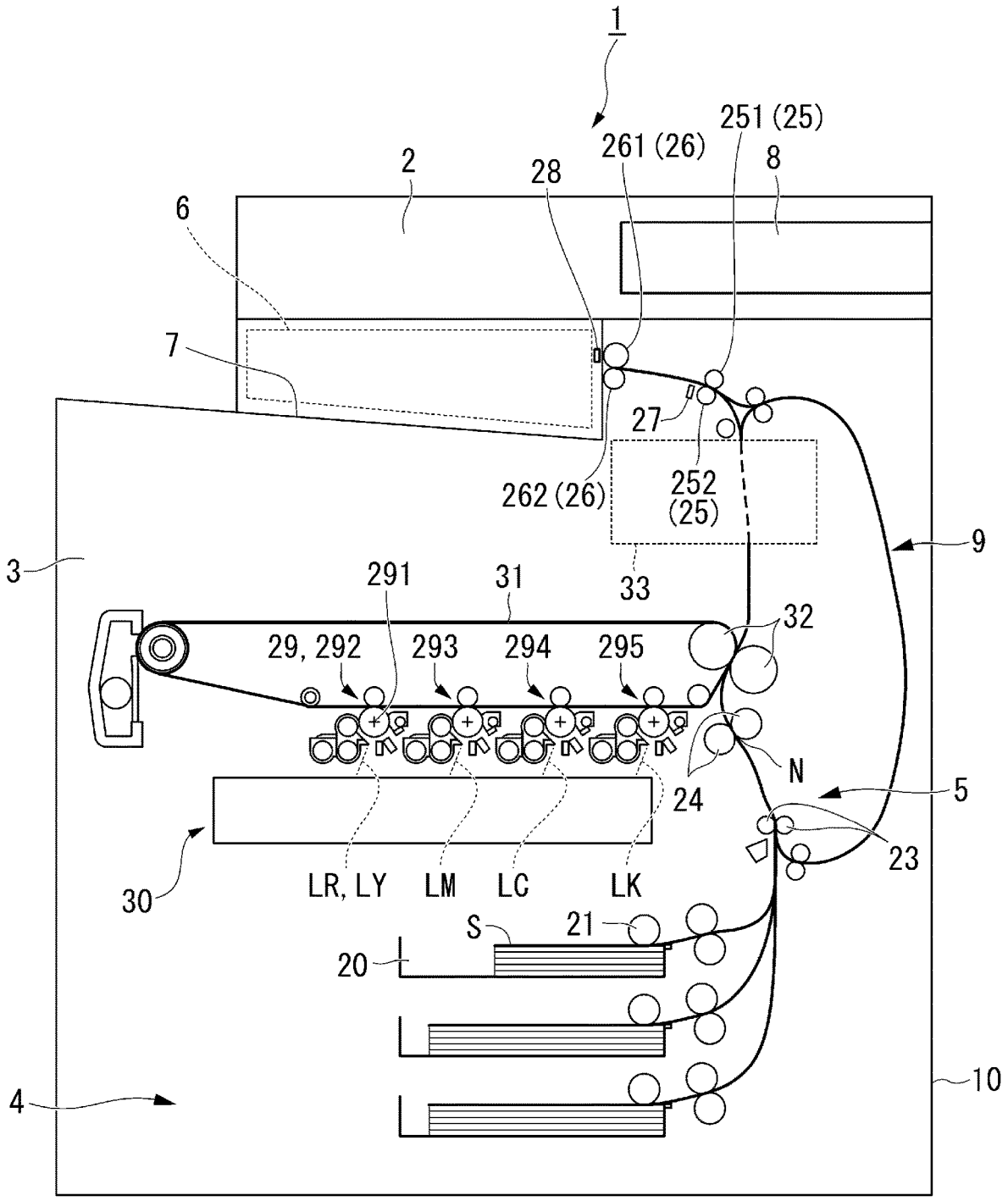
FIG. 1 is a diagram illustrating an example of a configuration of an image forming device 1.

FIG. 1 is a diagram illustrating an example of a configuration of the image forming device 1.

The image forming device 1 executes a process of forming an image on a printing medium S. The printing medium S is a sheet-like medium such as printing paper or a sticker mount.

The image forming device 1 includes a housing 10, a scanner unit 2, an image forming unit 3, a sheet supply unit 4, a conveyance unit 5, an ejection tray 7, a reversing unit 9, a control panel 8, and a control unit 6.

The housing 10 forms an outer shape of the image forming device 1.

The scanner unit 2 reads image information of an object to be copied based on brightness and darkness of light. The scanner unit 2 generates an image signal based on the read brightness and darkness of the light. The scanner unit 2 outputs the generated image signal to the image forming unit 3.

The image forming unit 3 forms an output image with a recording agent such as a toner based on an image signal received from the scanner unit 2 or an image signal received from the outside. Hereinafter, for convenience of explanation, this output image is referred to as a toner image. The image forming unit 3 transfers the formed toner image to the front surface of the printing medium S. The image forming unit 3 heats and pressurizes the toner image transferred to the front surface of the printing medium S to fix the toner image to the printing medium S.

The sheet supply unit 4 supplies the printing media S one by one, to the conveyance unit 5 at the timing when the image forming unit 3 forms a toner image. The sheet supply unit 4 includes a sheet containing unit 20 and a pickup roller 21.

The sheet containing unit 20 contains the printing media S of the predetermined size and type.

The pickup roller 21 picks up the printing media S one by one from the sheet containing unit 20. The pickup roller 21 supplies the extracted printing medium S to the conveyance unit 5.

The conveyance unit 5 conveys the printing medium S supplied from the sheet supply unit 4 to the image forming unit 3. The conveyance unit 5 includes a conveyance roller unit 23, a registration roller unit 24, an intermediate roller unit 25, a paper ejection roller unit 26, a detection unit 27, a static elimination brush 28, and a moving unit 281. In FIG. 1, in order to simplify the diagram, the moving unit 281 is omitted.

The conveyance roller unit 23 is configured with two rollers of a paper feed roller and a separation roller that face each other. The conveyance roller unit 23 conveys the printing media S supplied from the pickup roller 21 one by one, to the registration roller unit 24. The conveyance roller unit 23 abuts the front end of the printing medium S in the conveyance direction to a nip N of the two rollers of the registration roller unit 24.

The registration roller unit 24 is configured with two rollers that face each other. The nip N is a nip of these two rollers. The registration roller unit 24 causes the printing medium S to bend at the nip N, to align the position of the front end of the printing medium S in the conveyance direction. The registration roller unit 24 conveys the printing medium S in response to the timing when the image forming unit 3 transfers the toner image to the printing medium S.

The intermediate roller unit 25 is configured with two rollers of a roller 251 and a roller 252 that face each other. The printing medium S after an image is formed by the image forming unit 3 is supplied to the intermediate roller unit 25. The intermediate roller unit 25 conveys the printing medium S supplied from the image forming unit 3 to the paper ejection roller unit 26.

The paper ejection roller unit 26 is configured with two rollers of a roller 261 and a roller 262 that face each other. The paper ejection roller unit 26 sandwiches the printing medium S supplied from the intermediate roller unit 25 between the roller 261 and the roller 262 and conveys the printing medium S in the conveyance direction. Accordingly, the paper ejection roller unit 26 conveys the printing medium S supplied from the intermediate roller unit 25 to the ejection tray 7. Accordingly, the paper ejection roller unit 26 is configured with two rollers that are the closest to the ejection tray 7 in the conveyance path. In other words, the paper ejection roller unit 26 is positioned on the downstream side from the image forming unit 3 in the conveyance path through which the printing medium S is conveyed. Specifically, the paper ejection roller unit 26 is positioned on the downstream side from a fixing device 33 in the image forming unit 3 in the conveyance path. The paper ejection roller unit 26 is an example of the roller unit.

Any one roller of the roller 261 and the roller 262 in the paper ejection roller unit 26 includes together with the roller a first gear 2611 that rotates about the same axis as the roller. For example, a case where the roller 261 includes the first gear 2611 is described. In FIG. 1, in order to simplify the diagram, the first gear 2611 is omitted. A target with which the first gear 2611 meshes is described below.

The detection unit 27 detects that the front end of the printing medium S passes a detection position SP determined in advance on the second conveyance path on the upstream side from the paper ejection roller unit 26 in the conveyance path. The detection unit 27 is a contact sensor that detects the contact with the printing medium S, for example, at the detection position SP. In this case, the detection unit 27 includes an actuator 271 and a sensor 272.

Figure 2:
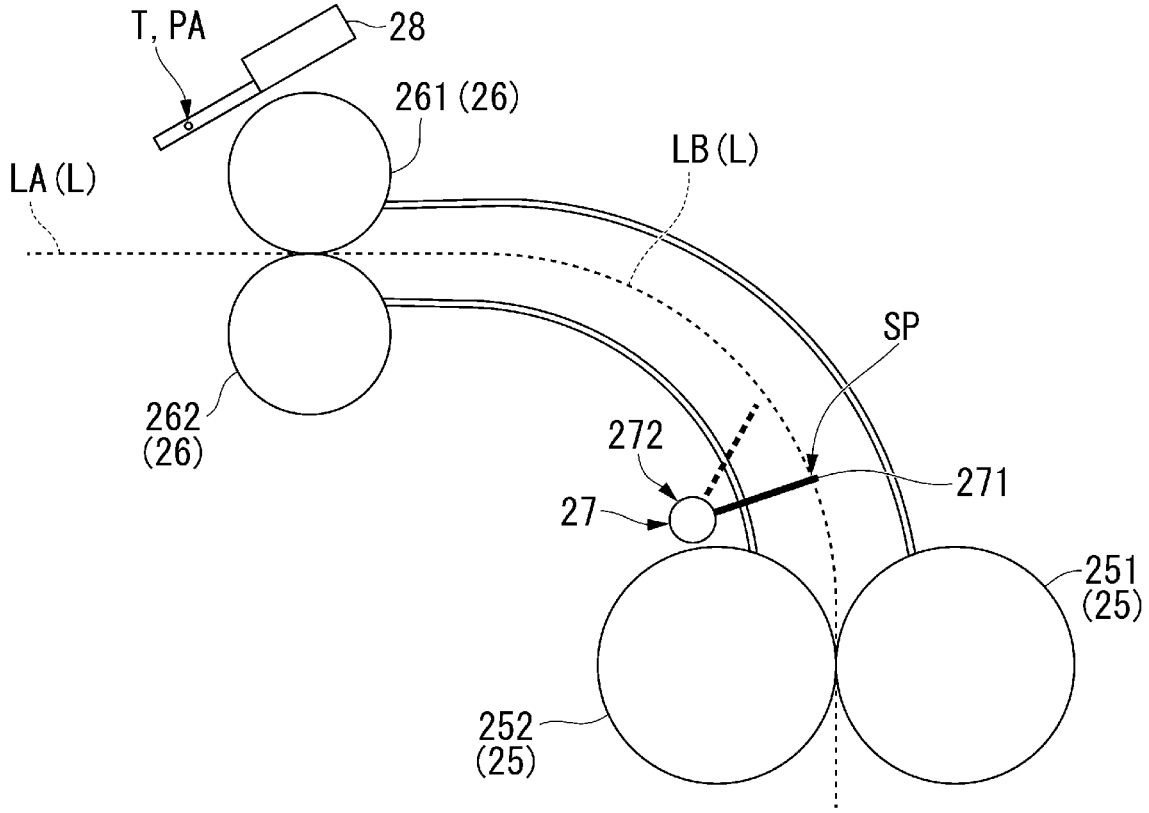
FIG. 2 is an enlarged view of the periphery of a detection unit 27 illustrated in FIG. 1.

FIG. 2 is an enlarged view of the periphery of the detection unit 27 illustrated in FIG. 1. A dotted line L illustrated in FIG. 2 illustrates an example of the conveyance path.

If the printing medium S passes the detection position SP, the actuator 271 is a rod-like member that rotates about the axis determined in advance by being pushed by the printing medium S. If the printing medium S passes the detection position SP, the actuator 271 may be a member of another shape that can rotate about an axis determined in advance by being pushed by the printing medium S.

The sensor 272 is a sensor that detects the actuator 271 rotating by being pushed by the printing medium S. The sensor 272 is, for example, an optical sensor, but may be a sensor of another type that can detect the actuator 271 rotating by being pushed by the printing medium S.

The detection unit 27 may be another sensor that can detect that the front end of the printing medium S passes the detection position SP. For example, the detection unit 27 may be an optical sensor that can detect that the front end of the printing medium S passes the detection position SP. In this case, the detection unit 27 is a non-contact sensor that detects the contact with the printing medium S at the detection position SP.

In the example illustrated in FIG. 2, the detection unit 27 is positioned between the paper ejection roller unit 26 and the intermediate roller unit 25 in the conveyance path. The detection unit 27 may be positioned on the upstream side from the intermediate roller unit 25 in the conveyance path instead of being configured to be positioned between the paper ejection roller unit 26 and the intermediate roller unit 25. Two rollers that configure the intermediate roller unit 25 are examples of two rollers that are the closest to the paper ejection roller unit 26 and positioned upstream from the paper ejection roller unit 26 among the rollers in the image forming device 1.

The static elimination brush 28 eliminates static electricity of the printing medium S. The static elimination brush 28 includes a brush that eliminates the static electricity of the printing medium S by being brought into contact with the printing medium S and a main body that bundles the brush. The static elimination brush 28 may be configured with another member that can eliminate the static electricity of the printing medium S by being brought into contact with the printing medium S, instead of the brush.

The static elimination brush 28 is provided to be movable between two positions of a first position PA and a second position PB which are determined in advance. The position of the static elimination brush 28 is represented by a position of a portion determined in advance among portions in the static elimination brush 28. As an example, a case where the position of the static elimination brush 28 is represented by the position of the center of the brush in the static elimination brush 28 is described.

The first position PA is a position where a first conveyance path on the downstream side of the paper ejection roller unit 26 in the conveyance path and the static elimination brush 28 do not intersect. Therefore, if the static elimination brush 28 is positioned at the first position PA, the static elimination brush 28 may not be in contact with the printing medium that passes the first conveyance path. The first position PA is a position where the static elimination brush 28 can be positioned, and may be any position as long as the first conveyance path and the static elimination brush 28 do not intersect.

The second position PB is a position where the first conveyance path on the downstream side of the paper ejection roller unit 26 in the conveyance path and the static elimination brush 28 intersect. Specifically, the second position PB is a position where the brush in the static elimination brush 28 intersects with the first conveyance path. As an example, a case where the second position PB is positioned on the first conveyance path is described. In this case, the center of gravity of the brush in the static elimination brush 28 positioned at the second position PB overlaps the first conveyance path. Therefore, if the static elimination brush is positioned at the second position PB, the static elimination brush 28 is in contact with the printing medium that passes the first conveyance path.

Here, FIG. 2 described above is a diagram illustrating an example of a state in which the static elimination brush 28 is positioned at the first position PA. In FIG. 2, the detection unit 27 including the actuator 271 and the sensor 272, and the intermediate roller unit 25 are illustrated together with the static elimination brush 28. The direction from the intermediate roller unit 25 to the paper ejection roller unit 26 among directions along the dotted lines L illustrating the conveyance path is an example of the conveyance direction. A dotted line LA on the downstream side from the paper ejection roller unit 26 in the conveyance direction among the dotted lines L is an example of the first conveyance path. A dotted line LB on the upstream side from the paper ejection roller unit 26 in the conveyance direction among the dotted lines L shows an example of the second conveyance path. A position T illustrated in FIG. 2 illustrates a position of the center of gravity of the brush in the static elimination brush 28, that is, a position of the static elimination brush 28 according to the embodiment. In FIG. 2, the position T is identical to the first position PA. That is, the static elimination brush 28 illustrated in FIG. 2 is positioned at the first position PA.

Figure 3:
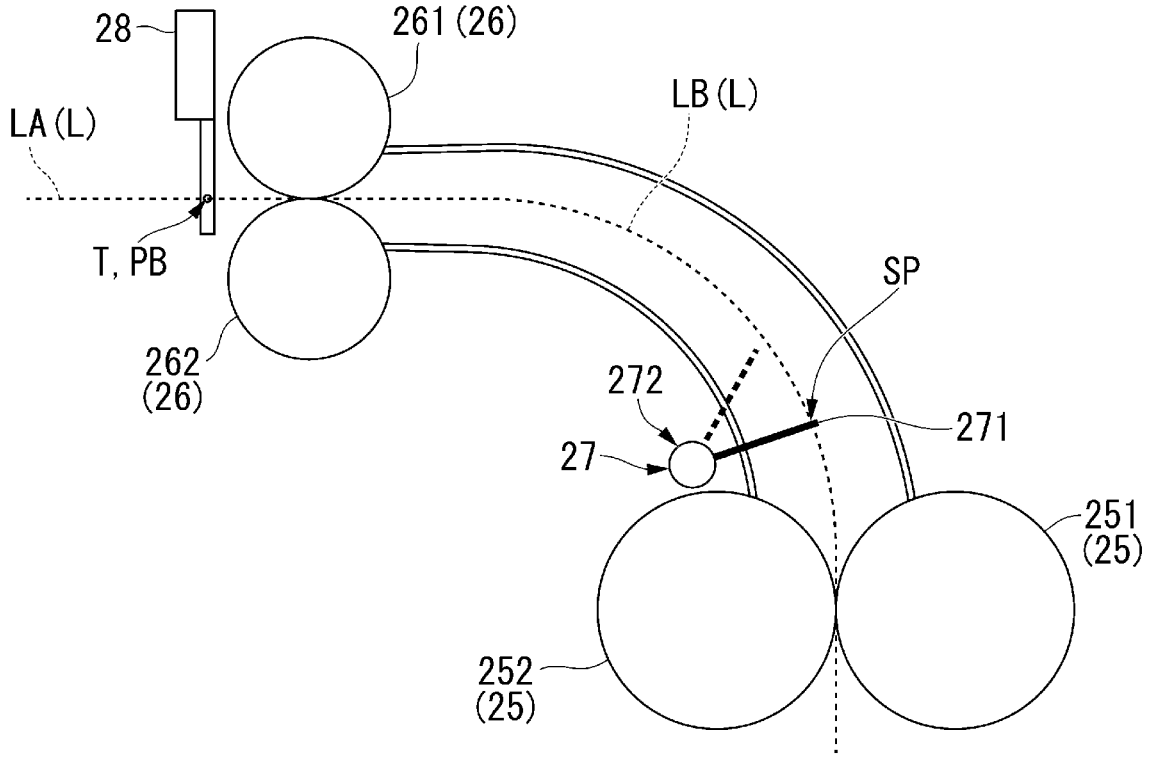
FIG. 3 is a diagram illustrating an example of a state after a static elimination brush 28 illustrated in FIG. 2 moves to a second position PB.

Meanwhile, FIG. 3 is a diagram illustrating an example of a state after the static elimination brush 28 illustrated in FIG. 2 moves to the second position PB. In FIG. 3, the position T is identical to the second position PB. That is, the static elimination brush 28 illustrated in FIG. 3 is positioned at the second position PB.

The static elimination brush 28 is moved between the first position PA and the second position PB by the moving unit 281.

The moving unit 281 moves the static elimination brush 28 between the first position PA and the second position PB. The moving unit 281 may be any member as long as the member can move the static elimination brush 28 between the first position PA and the second position PB. As an example, a case where the moving unit 281 has the configuration illustrated in FIG. 4 is described.

Figure 4:
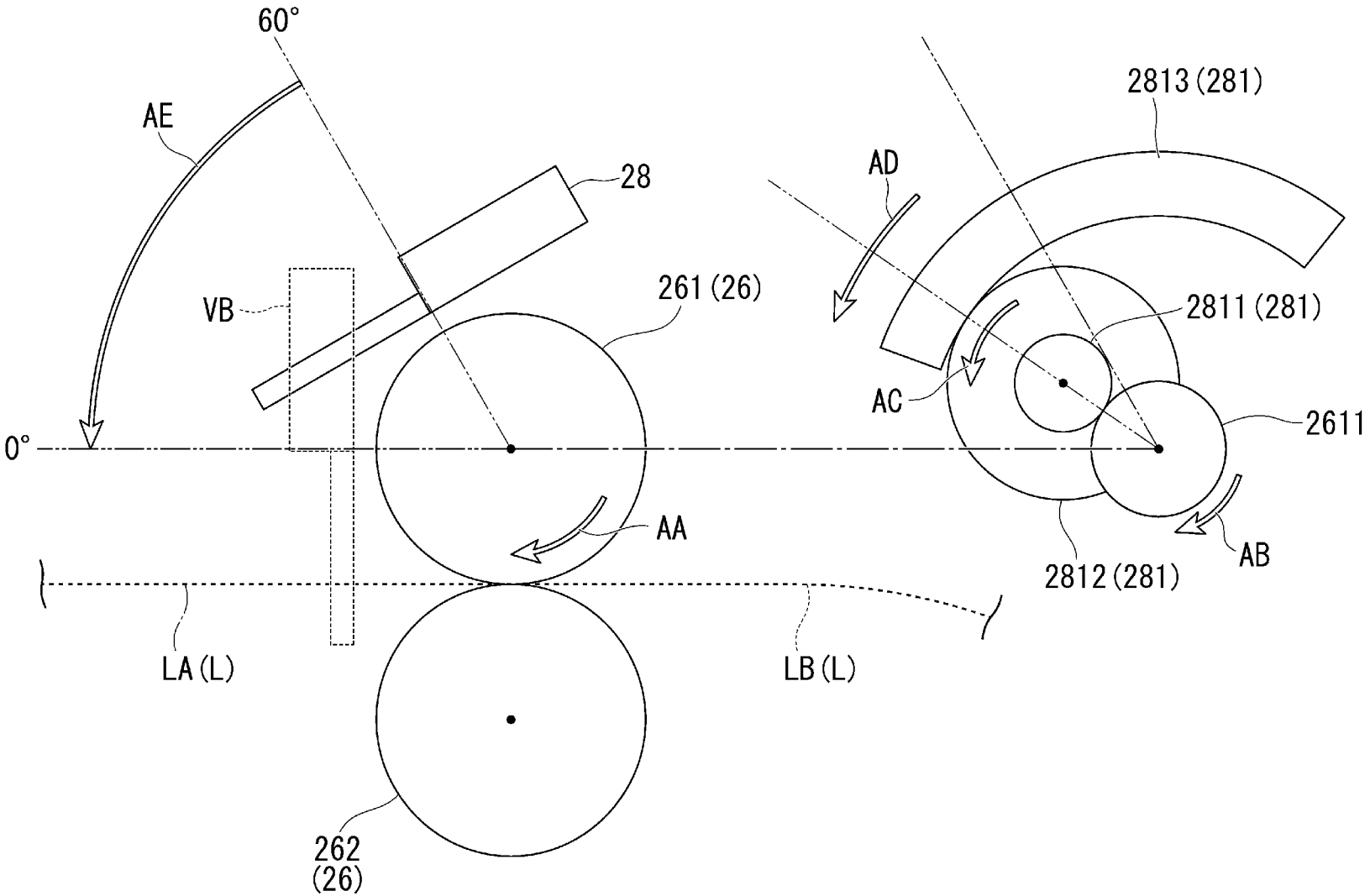
FIG. 4 is a diagram illustrating an example of a configuration of a moving unit 281.

FIG. 4 is a diagram illustrating an example of a configuration of the moving unit 281. As described above, according to the embodiment, as illustrated in FIG. 4, the roller 261 includes the first gear 2611. In the example illustrated in FIG. 4, the static elimination brush 28 is positioned at the first position PA. The moving unit 281 moves the static elimination brush 28 between the first position PA and the second position PB in response to the rotation of the first gear 2611. Therefore, the moving unit 281 includes a second gear 2811, a third gear 2812, and a round rack 2813. The second gear 2811 is a gear that meshes with the first gear 2611. The third gear 2812 is a gear that rotates about the same axis as the second gear 2811 together with the second gear 2811. The round rack 2813 is a rack that is bent in an arc shape along a circle centered on the rotation axis of the first gear 2611. Among the surfaces in the round rack 2813, teeth that mesh with the third gear 2812 are formed on the surface on the first gear 2611 side. Accordingly, the round rack 2813 is a round rack that rotates in response to the rotation of the third gear 2812.

The static elimination brush 28 is provided in the round rack 2813. Therefore, the static elimination brush 28 rotates according to the rotation of the round rack 2813 to move between the first position PA and the second position PB.

The second gear 2811 and the third gear 2812 are connected to each other via a torque limiter. Therefore, if the static elimination brush 28 is moved from the first position PA to the second position PB, the moving unit 281 can suppress the movement of the static elimination brush 28 to a position beyond the second position PB. If the static elimination brush 28 is moved from the second position PB to the first position PA, the moving unit 281 can suppress the movement of the static elimination brush 28 to a position beyond the first position PA.

In the example illustrated in FIG. 4, if the static elimination brush 28 is seen along the rotation axis of the first gear 2611, an acute angle between the line segment connecting the rotation axis of the first gear 2611 to the base of the brush of the static elimination brush 28 and the conveyance path is 60°. This means that the acute angle between the line segment if the static elimination brush 28 is positioned at the first position PA and the conveyance path is 60° in the corresponding example.

If the roller 261 rotates in the direction illustrated by an arrow AA illustrated in FIG. 4, the first gear 2611 rotates together with the roller 261 and thus rotates in the direction illustrated by an arrow AB. In response to this rotation of the first gear 2611, the second gear 2811 rotates in the direction illustrated by an arrow AC. The third gear 2812 rotates in the direction illustrated by an arrow AD together with this rotation of the second gear 2811. As a result, the round rack 2813 rotates in the direction illustrated by the arrow AD. In response to this rotation of the round rack 2813, the static elimination brush 28 rotates together with the round rack 2813, and thus rotates in the direction illustrated by an arrow AE. Therefore, the static elimination brush 28 moves from the first position PA to the second position PB. A dotted line VB illustrated in FIG. 4 is an example of the contour of the static elimination brush 28 positioned at the second position PB.

Figure 5:
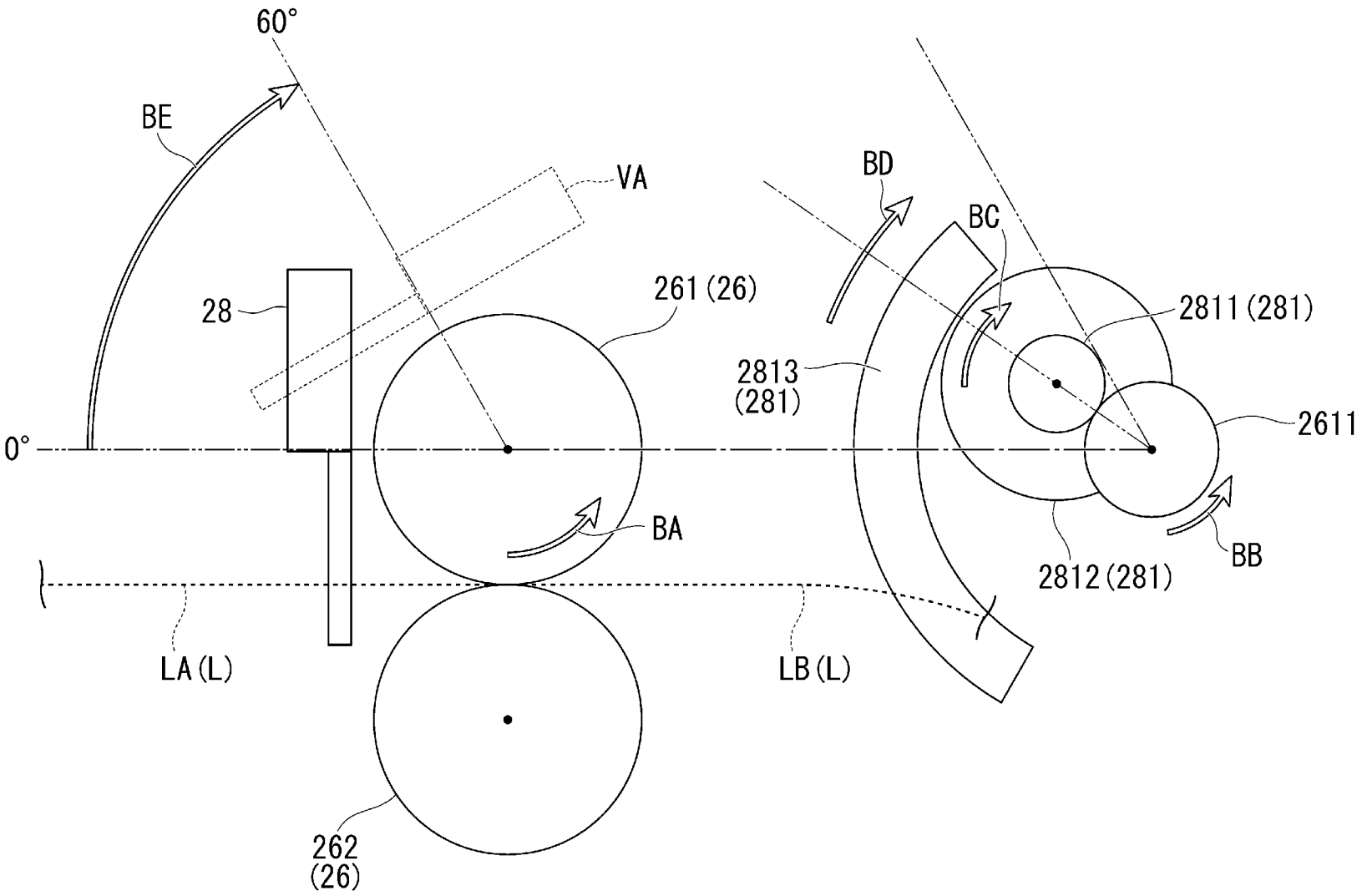
FIG. 5 is a diagram illustrating an example of a state of the moving unit 281 if the static elimination brush 28 is positioned at the second position PB.

FIG. 5 is a diagram illustrating an example of a state of the moving unit 281 if the static elimination brush 28 is positioned at the second position PB. In the example illustrated in FIG. 5, if the static elimination brush 28 is seen along the rotation axis of the first gear 2611, the acute angle between the line segment connecting the rotation axis of the first gear 2611 to the base of the brush of the static elimination brush 28 and the conveyance path is 0°. This means that the acute angle between the corresponding line segment if the static elimination brush 28 is positioned at the second position PB and the conveyance path is 0° in the corresponding example. Accordingly, in the examples illustrated in FIGS. 4 and 5, the position of the static elimination brush 28 between the first position PA and the second position PB can be shown by the angle from 0° to 60°. For convenience of explanation, the angle illustrating the position of the static elimination brush 28 is referred to as a moving angle, in the description.

If the roller 261 rotates in the direction illustrated by an arrow BA illustrated in FIG. 5, the first gear 2611 rotates together with the roller 261, and thus rotates in the direction illustrated by an arrow BB. The second gear 2811 rotates in response to this rotation of the first gear 2611, and thus the third gear 2812 rotates in the direction illustrated by an arrow BC. As a result, the round rack 2813 rotates in the direction illustrated by an arrow BD. In response to this rotation of the round rack 2813, the static elimination brush 28 rotates together with the round rack 2813 and thus rotates in the direction illustrated by an arrow BE. Therefore, the static elimination brush 28 moves from the second position PB to the first position PA. A dotted line VA illustrated in FIG. 5 is an example of the contour of the static elimination brush 28 positioned at the first position PA.

Instead of the configurations illustrated in FIGS. 4 and 5, the moving unit 281 may have another configuration that can move the static elimination brush 28 between the first position PA and the second position PB. For example, the moving unit 281 may have a configuration including a rack that linearly moves in response to the rotation of the third gear 2812 instead of the round rack 2813. In this case, the static elimination brush 28 is provided in this rack that linearly moves and linearly moves between the first position PA and the second position PB.

Hereinafter, the image forming unit 3 is specifically described.

The image forming unit 3 includes a plurality of image forming units 29, a laser scanning unit 30, an intermediate transfer belt 31, a transfer unit 32, and the fixing device 33.

The image forming units 29 includes photoconductor drums 291. The image forming units 29 form toner images according to an image signal received from the scanner unit 2 or an image signal received from the outside on the photoconductor drums 291. The plurality of image forming units 292, 293, 294, and 295 form toner images with toners of yellow, magenta, cyan, and black, respectively.

Chargers, developing devices, and the like are arranged in the periphery of the photoconductor drums 291. The chargers charge the front surfaces of the photoconductor drums 291. The developing devices contain the developers including yellow, magenta, cyan, and black toners. The developing devices develop the electrostatic latent images on the photoconductor drums 291. As a result, the toner images by toners of respective colors are formed on the photoconductor drums 291.

The laser scanning unit 30 deflects laser light LR to the charged photoconductor drum 291 and exposes the photoconductor drums 291. The laser scanning unit 30 exposes the photoconductor drums 291 of the image forming units 292, 293, 294, and 295 of the respective colors with the respective laser light LY, LM, LC, and LK. Accordingly, the laser scanning unit 30 forms the electrostatic latent images on the photoconductor drums 291.

The toner images on the front surfaces of the photoconductor drums 291 are primarily transferred to the intermediate transfer belt 31.

The transfer unit 32 transfers the toner images primarily transferred to the intermediate transfer belt 31 to the front surface of the printing medium S at a secondary transfer position.

The fixing device 33 heats and pressurizes the toner images transferred to the printing medium S to fix the toner images to the printing medium S.

The reversing unit 9 reverses the printing medium S in order to form the image on the back surface of the printing medium S. The reversing unit 9 reverses the front and the back of the printing medium S ejected from the fixing device 33 by switching back. The reversing unit 9 conveys the reversed printing medium S toward the registration roller unit 24.

The ejected printing medium S with the image formed is placed on the paper ejection tray 7.

The control panel 8 is a portion of an input unit that receives an input of the information for operating the image forming device 1 by an operator. The control panel 8 includes a touch panel, various hard keys, and the like.

The control unit 6 controls various units of the image forming device 1. The position of the control unit 6 illustrated in FIG. 1 is merely an example, and may be another position inside the image forming device 1.

Figure 6:
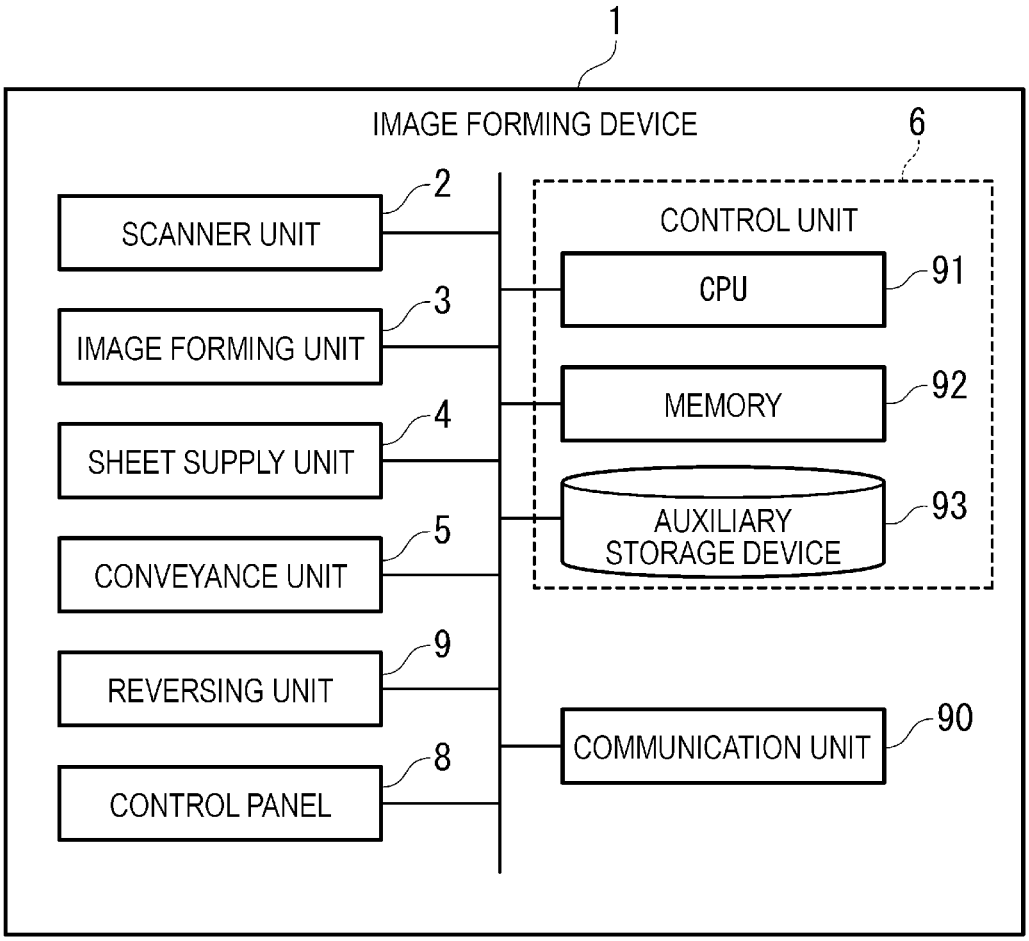
FIG. 6 is a hardware configuration diagram of the image forming device 1.

FIG. 6 is a hardware configuration diagram of the image forming device 1. The image forming device 1 includes a Central Processing Unit (CPU) 91, a memory 92, an auxiliary storage device 93, and the like connected to each other via a bus, and executes various programs. The image forming device 1 functions as a device including the scanner unit 2, the image forming unit 3, the sheet supply unit 4, the conveyance unit 5, the reversing unit 9, the control panel 8, and a communication unit 90 according to the execution of the various programs.

The CPU 91 functions as the control unit 6 by the execution of the various programs stored in the memory 92 and the auxiliary storage device 93. The control unit 6 controls operations of functional units of the image forming device 1.

The auxiliary storage device 93 is configured by using a storage device such as a magnetic hard disk device or a semiconductor storage device. The auxiliary storage device 93 stores various kinds of information.

The communication unit 90 is configured to include a communication interface for connecting the own device to an external device. The communication unit 90 communicates with the external device via the communication interface.

Hereinafter, processes executed by the control unit 6 are described.

Figure 7:
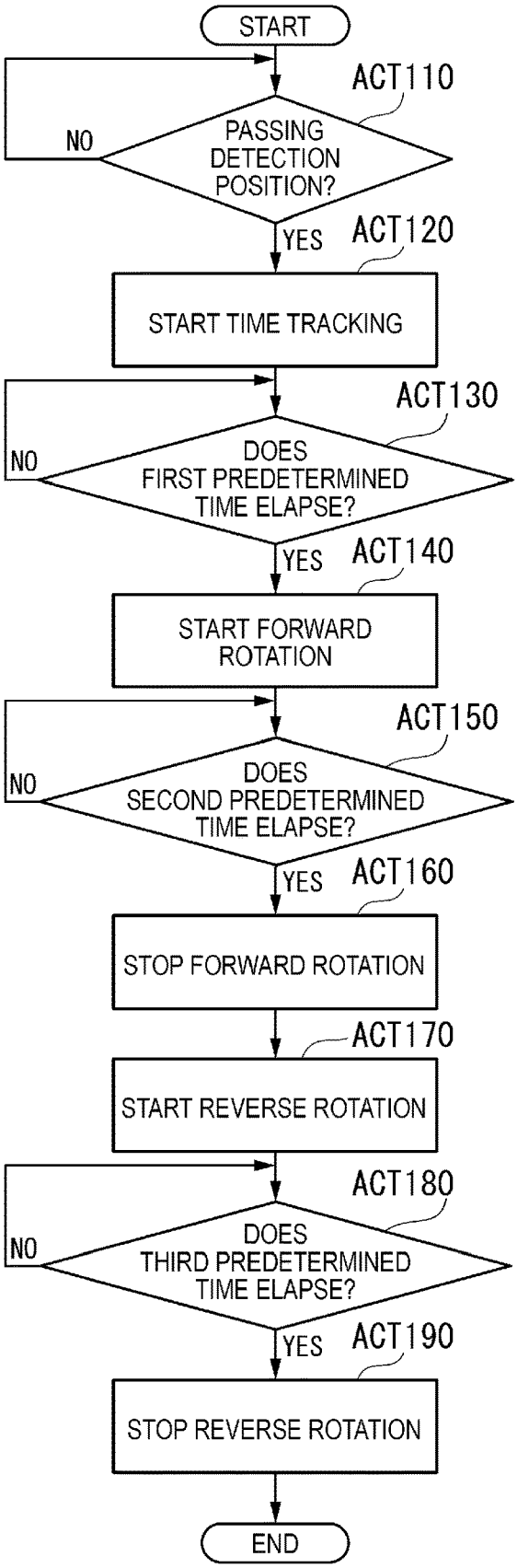
FIG. 7 is a diagram illustrating an example of a static elimination brush moving process among processes executed by a control unit 6.

FIG. 7 is a diagram illustrating an example of a static elimination brush moving process among processes executed by the control unit 6. A static elimination brush moving process is a process of moving the static elimination brush 28 between the first position PA and the second position PB. For example, whenever the image forming device 1 conveys the printing medium S along the conveyance path, the control unit 6 repeats processes of the flowchart illustrated in FIG. 7.

The control unit 6 waits until the detection unit 27 detects that the front end of the printing medium S passes the detection position SP (ACT 110). FIG. 7 illustrates the process of ACT 110 as "passing detection position?"

If it is determined that the detection unit 27 detects that the front end of the printing medium S passes the detection position SP (ACT 110—YES), the control unit 6 starts time tracking (ACT 120).

Subsequently, the control unit 6 waits until first predetermined time determined in advance elapses from the timing when the time tracking starts in ACT 120 (ACT 130).

If it is determined that the first predetermined time elapses from the timing when the time tracking starts in ACT 120 (ACT 130—YES), the control unit 6 starts the rotation of the paper ejection roller unit 26 in the forward direction (ACT 140). FIG. 7 illustrates the process of ACT 140 as "start forward rotation". The rotation of the paper ejection roller unit 26 in the forward direction corresponds to the control of the moving unit 281 so that the static elimination brush 28 moves from the first position PA to the second position PB. The forward direction is the direction in which the roller 261 and the roller 262 rotate if the printing medium S sandwiched between the roller 261 and the roller 262 is conveyed from the second conveyance path toward the first conveyance path. In the example illustrated in FIG. 4, the forward direction is the direction illustrated by the arrow AA. The first predetermined time is time determined so that the static elimination brush 28 is in contact with the printing medium S and the static elimination brush 28 finishes the movement to the second position PB after the front end of the printing medium S passes the intersection position until the rear end of the printing medium S passes the intersection position. That is, by the process of ACT 140, the control unit 6 brings the static elimination brush 28 into contact with the printing medium S and positions the static elimination brush 28 at the second position PB after the front end of the printing medium S passes the intersection position until the rear end of the printing medium S passes the intersection position.

Accordingly, the control unit 6 can improve the efficiency of the elimination of the static electricity of the printing medium S by the static elimination brush 28 while the hindrance of the conveyance of the printing medium S by the static elimination brush 28 is suppressed. The first predetermined time may be determined by trial and error, may be determined by theoretical calculation, or may be determined by another method.

Subsequently, the control unit 6 waits until second predetermined time determined in advance elapses from the timing when the time tracking starts in ACT 120 (ACT 150). The second predetermined time is time determined so that the rotation of the paper ejection roller unit 26 in the forward direction continues while the rear end of the printing medium S finishes the passage of the intersection position. The second predetermined time may be determined by trial and error, may be determined by theoretical calculation, or may be determined by another method.

If it is determined that the second predetermined time elapses from the timing when the time tracking starts in ACT 120 (ACT 150—YES), the control unit 6 stops the rotation of the paper ejection roller unit 26 in the forward direction (ACT 160). FIG. 7 illustrates the process of ACT 160 as "stop forward rotation".

Subsequently, the control unit 6 starts the rotation of the paper ejection roller unit 26 in the reverse direction (ACT 170). FIG. 7 illustrates the process of ACT 170 as "start reverse rotation". The reverse direction refers to a direction opposite to the forward direction. By the processes of ACTS 160 and 170, the control unit 6 moves the static elimination brush 28 from the second position PB to the first position PA after the rear end of the printing medium S passes the intersection position. Accordingly, the control unit 6 can position the static elimination brush 28 at a position different from the second position PB until the front end of the printing medium S subsequently conveyed passes the intersection position.

Next, the control unit 6 waits until third predetermined time determined in advance elapses from the timing when the time tracking starts in ACT 120 (ACT 180). The third predetermined time is time determined so that the static elimination brush 28 that starts the movement by the process of ACT 170 reaches the first position PA. The third predetermined time may be determined by trial and error, may be determined by theoretical calculation, or may be determined by another method.

If it is determined that the third predetermined time elapses from the timing when the time tracking starts in ACT 120 (ACT 180—YES), the control unit 6 stops the rotation of the paper ejection roller unit 26 in the reverse direction (ACT 190). FIG. 7 illustrates the process of ACT 190 as "stop reverse rotation". After the process of ACT 190, the control unit 6 ends the processes of the flowchart illustrated in FIG. 7.

In the processes of the flowchart illustrated in FIG. 7, the shorter the elapsed time from the timing when time tracking starts in ACT 120, the more difficult the relationship between the elapsed time and the position of the printing medium S deviates due to an error. Therefore, as in the embodiment, it is desirable that the detection unit 27 is positioned between the paper ejection roller unit 26 and the intermediate roller unit 25 in the conveyance path. However, as long as the deviation is small, the detection unit 27 may be configured to be positioned upstream the conveyance path from the intermediate roller unit 25.

Figure 8:
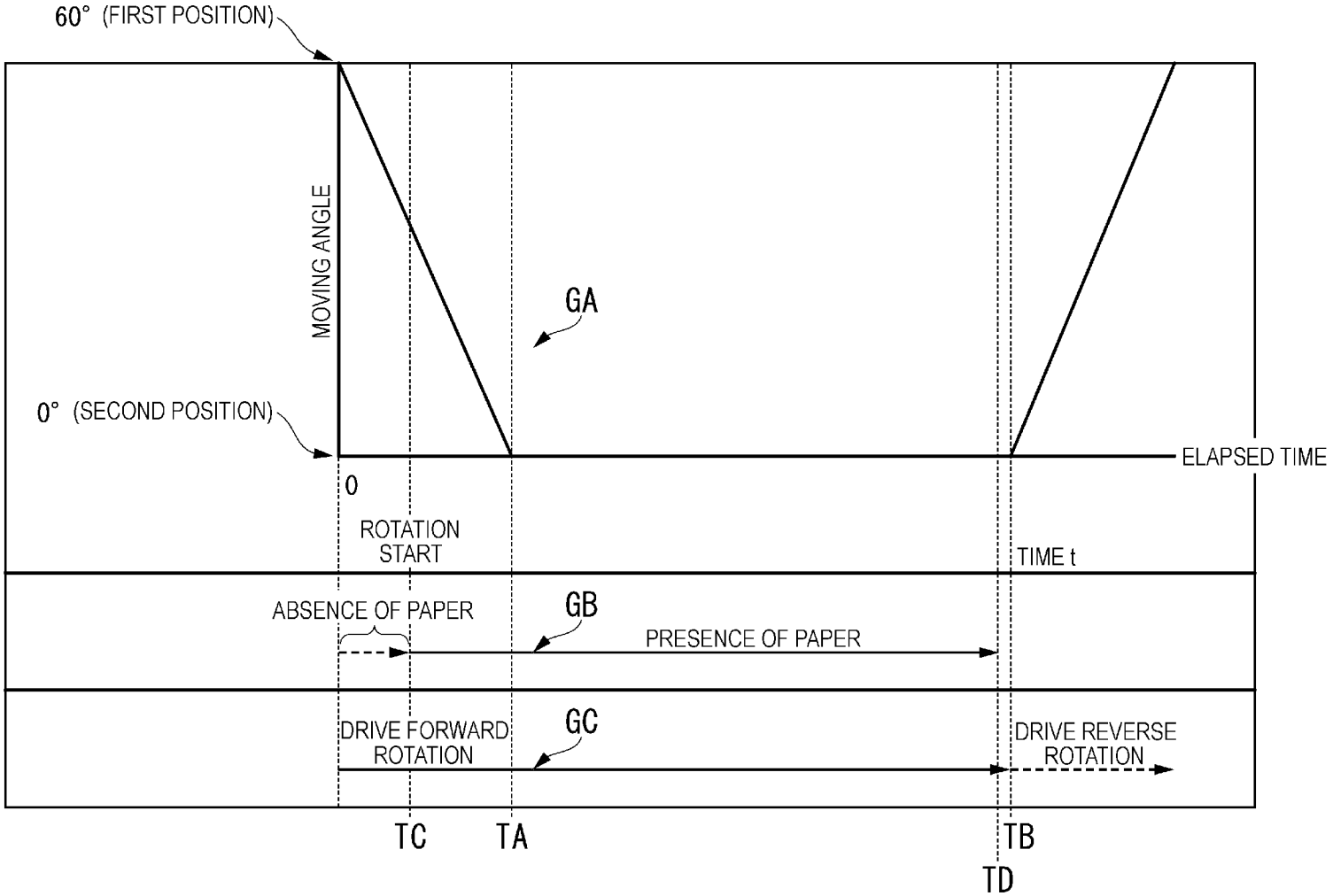
FIG. 8 is a timing chart illustrating examples of respective temporal changes of the rotation of a paper ejection roller unit 26, the position of a printing medium S, and the position of the static elimination brush 28.

FIG. 8 is a timing chart illustrating examples of respective temporal changes of the rotation of the paper ejection roller unit 26, the position of the printing medium S, and the position of the static elimination brush 28.

A graph GA illustrated in FIG. 8 is a graph illustrating the temporal change of the position of the static elimination brush 28. The vertical axis of the graph GA illustrates the position of the static elimination brush 28. In the graph GA, the position of the static elimination brush 28 is illustrated by the moving angle. The horizontal axis of the graph GA illustrates the elapsed time from the timing when the paper ejection roller unit 26 starts rotation in the forward direction. In other words, the corresponding horizontal axis illustrates the elapsed time from the timing when the process of ACT 140 illustrated in FIG. 7 is executed. Therefore, at the timing when the elapsed time is 0 in the graph GA, the static elimination brush 28 is positioned at the first position PA. The timing when the elapsed time is TA illustrated in FIG. 8 is timing when the static elimination brush 28 reaches the second position PB. The timing when the elapsed time is TB illustrated in FIG. 8 illustrates the timing when the paper ejection roller unit 26 starts the rotation in the reverse direction, that is, timing when the static elimination brush 28 starts the movement from the second position PB to the first position PA.

A graph GB illustrated in FIG. 8 is a graph illustrating the temporal change of the presence or the absence of the printing medium S at the intersection position. The vertical axis of the graph GB illustrates nothing. The horizontal axis of the graph GB is identical to the horizontal axis of the graph GA, and illustrates the elapsed time from the timing when the paper ejection roller unit 26 starts the rotation in the forward direction. The timing when the elapsed time is TC illustrated in FIG. 8 illustrates the timing when the front end of the printing medium S reaches the intersection position. Therefore, the period of time illustrated by the arrow of the dotted line in the graph GB illustrates the period of time when the intersection position and the printing medium S do not overlap each other. Meanwhile, the period of time illustrated by the solid arrow in the graph GB illustrates the period of time when the intersection position and the printing medium S overlap each other. The timing when the elapsed time is TD illustrated in FIG. 7 illustrates the timing when the rear end of the printing medium S passes the intersection position. That is, in the example illustrated in FIG. 8, the printing medium S passes the intersection position at the period of time from the timing illustrated by TC to the timing illustrated by TD.

A graph GC illustrated in FIG. 8 is a graph illustrating the temporal change of the rotation of the paper ejection roller unit 26. The vertical axis of the graph GC illustrates nothing. The horizontal axis of the graph GC is identical to the horizontal axis of the graph GA and illustrates the elapsed time from the timing when the paper ejection roller unit 26 starts the rotation in the forward direction. The period of time indicated by the solid arrow in the graph GC is the period of time when the paper ejection roller unit 26 rotates in the forward direction. The period of time indicated by the arrow of the dotted line in the graph GC is the period of time when the paper ejection roller unit 26 rotates in the reverse direction.

Among the periods of time illustrated in FIG. 8, from the timing illustrated by TC to the timing illustrated by TA, the static elimination brush 28 is in contact with the printing medium S. In other words, among the corresponding periods of time, during the period of time from the timing when the paper ejection roller unit 26 starts the rotation in the forward direction to the timing illustrated by TC, the static elimination brush 28 does not intersect the intersection position. Therefore, the image forming device 1 can suppress blocking the conveyance of the printing medium S by bringing the front end of the printing medium S into contact with the static elimination brush 28. Meanwhile, after the front end of the printing medium S passes the intersection position until the rear end of the printing medium S passes the intersection position, the image forming device 1 can bring the static elimination brush 28 into contact with the printing medium S. As a result, the image forming device 1 can efficiently eliminate static electricity of the printing medium S.

In the image forming device 1, the static elimination brush 28 described above is provided near the outlet of the paper ejection roller unit 26 on the ejection tray 7 side. Therefore, the image forming device 1 can eject the printing medium S to the ejection tray 7 immediately after the elimination of static electricity. In the image forming device 1, the static elimination brush 28 may be configured to be provided near the outlet of a roller unit different from the paper ejection roller unit 26.

The moving unit 281 described above has a configuration of moving the static elimination brush 28 between the first position PA and the second position PB by using the rotation of one of the two rollers in the paper ejection roller unit 26. However, the moving unit 281 may have the configuration including a mechanism that changes the direction of moving the static elimination brush 28 by using, for example, an electromagnetic clutch. The moving unit 281 may have a configuration including a mechanism that changes the direction of moving the static elimination brush 28, for example, via a plurality of gears.

As described above, the image forming device (the image forming device 1 in this example) includes an image forming unit (the image forming unit 3 in the example described above), a roller unit (the paper ejection roller unit 26 in the example described above), a static elimination brush (the static elimination brush 28 in the example described above), a moving unit (the moving unit 281 in the example described above), and a control unit (the control unit 6 in the example described above). The image forming device forms an image on a printing medium (the printing medium S in the example described above). The roller unit includes a first roller (the roller 261 in the example described above) that is position on a downstream side from the image forming unit in a conveyance path (a path illustrated by the dotted line L in the example described above) in which the printing medium is conveyed, a second roller (the roller 262 in the example described above) that is positioned on the downstream side from the image forming unit in the conveyance path and faces the first roller, sandwiches the printing medium between the first roller and the second roller, and conveys the printing medium in the first direction. The static elimination brush eliminates static electricity of the printing medium. The moving unit moves the static elimination brush between a first position (the first position PA in the example described above) that does not intersect a first conveyance path (the path illustrated by the dotted line LA in the example described above) on the downstream side of the roller unit in the conveyance path and a second position (the second position PB in the example described above) that intersects the first conveyance path. The control unit controls the moving unit during the conveyance of the printing medium, positions the static elimination brush at a position different from the second position until the front end of the printing medium passes the intersection position of intersecting the static elimination brush and the first conveyance path if the static elimination brush is positioned at the second position, and moves the static elimination brush to the second position after the front end of the printing medium passes the intersection position until the rear end of the printing medium passes the intersection position. Accordingly, the image forming device can efficiently eliminate static electricity of the printing medium while suppressing the occurrence of paper jam.

The image forming device further includes a detection unit (the detection unit 27 in the example described above) that detects that the front end of the printing medium passes the third position (the detection position SP in the example described above) in the second conveyance path (the path illustrated by the dotted line LB in the example described above) on the upstream side from the roller unit in the conveyance path, and may use the configuration in which the control unit controls the moving unit if the first time (the first predetermined time in the example described above) elapses after the detection unit detects that the front end of the printing medium passes the third position and moves the static elimination brush from the first position to the second position.

The image forming device may use the configuration in which the detection unit is a contact sensor that detects the contact with the printing medium at the third position.

The image forming device may use the configuration in which the detection unit includes an actuator (the actuator 271 in the example described above) that rotates about a first axis by being pushed by the printing medium if the printing medium passes the third position, and a sensor (the sensor 272 in the example described above) that detects the actuator rotating by being pushed by the printing medium.

The image forming device may use the configuration in which the detection unit is positioned the closest to the roller unit and upstream from the roller unit in the conveyance path and is position between two rollers (the roller 251 and the roller 252 of the intermediate roller unit 25 in the example described above) that convey the printing medium to the roller unit and the roller unit.

The image forming device may use the configuration in which the static elimination brush moves from the first position to the second position, if any one roller of the first roller and the second roller rotates in the first rotation direction (the forward direction in the example described above) and moves from the second position to the first position if the corresponding roller rotates in a second rotation direction (the reverse direction in the example described above) opposite to the first rotation direction, and the control unit rotates the corresponding roller in the first rotation direction, moves the static elimination brush in the second position, rotates the corresponding roller in the second rotation direction, and moves the static elimination brush to the first position.

The image forming device may use the configuration in which any one roller of the first roller and the second roller includes a first gear (the first gear 2611 in the example described above) that rotates about the same axis as the corresponding roller together with the corresponding roller, the moving unit includes a second gear (the second gear 2811 in the example described above) that meshes with the first gear, a third gear (the third gear 2812 in the example described above) that rotates about the same axis as the second gear together with the second gear, and a round rack (the round rack 2813 in the example described above) that rotates in response to the rotation of the third gear, and the static elimination brush is provided in the round rack that rotates about the rotation axis of the corresponding roller together with the round rack.

The image forming device may use the configuration in which the second gear and the third gear are connected to each other via a torque limiter.

The image forming device includes an ejection tray (the ejection tray 7 in the example described above) to which the printing medium is ejected after the image is formed by the image forming unit and may use the configuration in which the first roller and the second roller are the rollers that are the closest to the ejection tray in the conveyance path.

The image forming device may use the configuration in which the control unit moves any one roller of the first roller and the second roller from the second position to the first position after the rear end of the printing medium passes the intersection position.

A program for realizing the function of any configuration unit in the device described above (for example, the image forming device 1) may be recorded on a computer-readable recording medium, so that a computer system reads and executes the program. The term "computer system" as used herein includes hardware such as an Operating System (OS) and peripheral devices. The "computer-readable recording medium" refers to a portable medium such as a flexible disk, a magneto-optical disk, a ROM, a Compact Disk (CD)-ROM, or a storage device such as a hard disk built in a computer system. Furthermore, a "computer-readable recording medium" includes a medium that stores a program for a certain period of time such as a volatile memory (RAM) inside a computer system that serves as a server or client if a program is transmitted via a network such as the Internet or a communication line such as a telephone line.

Further, the above program may be transmitted from a computer system that stores this program in a storage device or the like to another computer system via a transmission medium or by a transmission wave in the transmission medium. Here, the "transmission medium" that transmits a program refers to a medium having a function of transmitting information such as a network (communication network) such as the Internet or a communication line such as a telephone line.

Further, the above program may be to realize a portion of the above functions. Further, the above program may be a so-called difference file (difference program) that can implement the above functions in combination with a program already recorded in the computer system.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming device, comprising:

an image forming component configured to form an image on a printing medium;

a roller unit comprising a first roller that is positioned on a downstream side from the image forming component in a conveyance path through which the printing medium is conveyed and a second roller that is positioned on the downstream side from the image forming component in the conveyance path and faces the first roller, configured to sandwich the printing medium between the first roller and the second roller and convey the printing medium in a first direction;

a static elimination brush configured to reduce static electricity of the printing medium;

a moving component configured to move the static elimination brush between a first position that does not intersect a first conveyance path on a downstream side of the roller unit in the conveyance path and a second position that intersects the first conveyance path; and a controller configured to control the moving component during the conveyance of the printing medium, position the static elimination brush at a position different from the second position until a front end of the printing medium passes an intersection position at which the static elimination brush and the first conveyance path intersect if the static elimination brush is positioned at the second position, and move the static elimination brush to the second position after the front end of the printing medium passes the intersection position until a rear end of the printing medium passes the intersection position.

2. The image forming device according to claim 1, further comprising:

a detector configured to detect that the front end of the printing medium passes a third position in a second conveyance path on an upstream side from the roller unit in the conveyance path, wherein the controller controls the moving component if a first time elapses after the detector detects that the front end of the printing medium passes the third position, and moves the static elimination brush from the first position to the second position.

3. The image forming device according to claim 2, wherein the detector is a contact sensor that detects contact with the printing medium at the third position.

4. The image forming device according to claim 3, wherein the detector includes an actuator that rotates about a first axis by being pushed by the printing medium if the printing medium passes the third position, and a sensor that detects the actuator rotating by being pushed by the printing medium.

5. The image forming device according to claim 2, wherein the detector is closest to the roller unit in the conveyance path and is positioned upstream from the roller unit and is positioned between two rollers conveying the printing medium to the roller unit and the roller unit.

6. The image forming device according to claim 1, wherein the static elimination brush moves from the first position to the second position if any one roller of the first roller and the second roller rotates in a first rotation direction and moves from the second position to the first position if the roller rotates in a second rotation direction opposite to the first rotation direction, and the controller rotates the roller in the first rotation direction, moves the static elimination brush to the second position, rotates the roller in the second rotation direction, and moves the static elimination brush to the first position.

7. The image forming device according to claim 6, wherein the roller includes a first gear that rotates about the same axis as the roller together with the roller, and the moving component includes a second gear that meshes with the first gear, a third gear that rotates about the same axis as the second gear together with the second gear, and a round rack that rotates in response to the rotation of the third gear, and the static elimination brush is provided in the round rack so as to rotate about a rotation axis of the roller together with the round rack.

8. The image forming device according to claim 7, wherein the second gear and the third gear are connected to each other via a torque limiter.

9. The image forming device according to claim 1, further comprising:

an ejection tray to which the printing medium after the image is formed by the image forming component is ejected, wherein the first roller and the second roller are rollers closest to the ejection tray in the conveyance path.

10. The image forming device according to claim 1, wherein the control unit moves the roller from the second position to the first position after the rear end of the printing medium passes the intersection position.

11. A method of reducing static electricity, comprising:

forming an image on a printing medium;

sandwiching the printing medium between a first roller and a second roller, the first roller positioned on a downstream side from image forming in a conveyance path and the second roller positioned on the downstream side from image forming in the conveyance path and faces the first roller;

conveying the printing medium in a first direction;

reducing static electricity of the printing medium using a static elimination brush;

moving the static elimination brush between a first position that does not intersect a first conveyance path on a downstream side in the conveyance path and a second position that intersects the first conveyance path; and controlling the moving during the conveyance of the printing medium;

positioning the static elimination brush at a position different from the second position until a front end of the printing medium passes an intersection position at which the static elimination brush and the first conveyance path intersect if the static elimination brush is positioned at the second position; and moving the static elimination brush to the second position after the front end of the printing medium passes the intersection position until a rear end of the printing medium passes the intersection position.

12. The method according to claim 11, further comprising:

detecting that the front end of the printing medium passes a third position in a second conveyance path on an upstream side from the first roller in the conveyance path;

controlling the moving component if a first time elapses after detecting that the front end of the printing medium passes the third position; and moving the static elimination brush from the first position to the second position.

13. The method according to claim 11, further comprising:

wherein the static elimination brush moves from the first position to the second position if any one roller of the first roller and the second roller rotates in a first rotation direction and moves from the second position to the first position if the roller rotates in a second rotation direction opposite to the first rotation direction, and the controller rotates the roller in the first rotation direction, moves the static elimination brush to the second position, rotates the roller in the second rotation direction, and moves the static elimination brush to the first position.

14. The method according to claim 11, further comprising:

an ejection tray to which the printing medium after the image is formed by the image forming component is ejected, wherein the first roller and the second roller are rollers closest to the ejection tray in the conveyance path.

15. The method according to claim 11, further comprising:

wherein the control unit moves the roller from the second position to the first position after the rear end of the printing medium passes the intersection position.

16. A static electricity reducing system, comprising:

a static elimination brush configured to eliminate static electricity of a printing medium;

a moving component configured to move the static elimination brush between a first position that does not intersect a first conveyance path on a downstream side of a roller unit in the conveyance path and a second position that intersects the first conveyance path; and a controller configured to control the moving component during the conveyance of the printing medium, position the static elimination brush at a position different from the second position until a front end of the printing medium passes an intersection position at which the static elimination brush and the first conveyance path intersect if the static elimination brush is positioned at the second position, and move the static elimination brush to the second position after the front end of the printing medium passes the intersection position until a rear end of the printing medium passes the intersection position.

17. The static electricity reducing system according to claim 16, further comprising:

a detector configured to detect that the front end of the printing medium passes a third position in a second conveyance path on an upstream side from the roller unit in the conveyance path, wherein the controller controls the moving component if first time elapses after the detector detects that the front end of the printing medium passes the third position, and moves the static elimination brush from the first position to the second position.

18. The static electricity reducing system according to claim 17, wherein the detector is a contact sensor that detects contact with the printing medium at the third position.

19. The static electricity reducing system according to claim 18, wherein the detector includes an actuator that rotates about a first axis by being pushed by the printing medium if the printing medium passes the third position, and a sensor that detects the actuator rotating by being pushed by the printing medium.

20. The static electricity reducing system according to claim 17, wherein the detector is closest to the roller unit in the conveyance path and is positioned upstream from the roller unit and is positioned between two rollers conveying the printing medium to the roller unit and the roller unit.

* * * * *